United States Patent [19]

Magin

[11] Patent Number: 4,965,918

[45] Date of Patent: Oct. 30, 1990

[54] PROCESS AND APPARATUS FOR TREATMENT OF TEXTILE FABRICS

[75] Inventor: Berthold Magin, Hassloch, Fed. Rep. of Germany

[73] Assignee: MTM Obermaier GmbH

[21] Appl. No.: 403,605

[22] Filed: Sep. 5, 1989

[30] Foreign Application Priority Data

Sep. 3, 1988 [DE] Fed. Rep. of Germany ..... 3829988

[51] Int. Cl.[5] ..... F26B 13/02; F26B 13/00; D06C 7/00

[52] U.S. Cl. ..... 26/18.5

[58] Field of Search ..... 26/18.5, 18.6, 19, 20

[56] References Cited

U.S. PATENT DOCUMENTS

| | | | |
|---|---|---|---|
| 2,730,786 | 1/1956 | Kindstrand et al. | 26/18.5 |
| 3,474,508 | 10/1969 | McCoy | 26/18.5 |
| 4,219,942 | 9/1980 | Coliva | 26/18.5 X |
| 4,392,309 | 7/1983 | Schrader et al. | 26/18.5 X |

FOREIGN PATENT DOCUMENTS

| | | | |
|---|---|---|---|
| 2927922 | 1/1981 | Fed. Rep. of Germany | 26/18.5 |

OTHER PUBLICATIONS

Marshall and Williams, Bulletin No. 2-70; Oct. 31, 1973.

*Primary Examiner*—Werner H. Schroeder
*Assistant Examiner*—Bradley Kurtz DeSandro
*Attorney, Agent, or Firm*—Toren, McGeady & Associates

[57] ABSTRACT

Textiles fabrics are guided with a sufficient lead between two essentially parallel revolving conveyor belts, and blowing nozzles and suction nozzles are alternately arranged above and below the conveyor belts so that one blowing nozzle lies respectively opposite each suction nozzle so as to enable air to be sucked through the fabric and impact a sinusoidal shaped curve to the fabric between the conveyor belts, the conveyor belts vibrating at least in sections and the vibrations being transmitted to the crests of the textile fabric, mutual spacing of the conveyor belts and the associated blowing and suction nozzles, the vibration frequency, and the speed of the conveyor belts being adjustable to the properties of the fabric being treated, such as weight, moisture content and air permeability.

29 Claims, 4 Drawing Sheets

PROCESS AND APPARATUS FOR TREATMENT OF TEXTILE FABRICS

BACKGROUND OF THE INVENTION

The present invention relates to a process and apparatus for treating textile fabrics, and more particularly, to a process and apparatus for drying, shrinking and finishing fabrics wherein the fabric is moved forward with sufficient overfeed between two parallel running conveyor belts, and is treated alternately from above and below by air from blowing nozzles.

Such a process and apparatus are known, for instance, from either DE-A No. 23 19 464 or DE-A No. 30 23 225. In these known processes, the fabric web is guided between two conveyor belts and heated air is blown on the web alternately at high speed from above and below the web. The air passing the fabric surface removes humidity therefrom so that the fabric is dried. Mechanical movement and beating of the fabric to the conveyor belts loosens up the tension in the fibers and, in woven or knitted fabrics, also serves to shrink the fabric during drying.

While the shrinking efficiency of these well-known processes is rather good, the drying efficiency thereof is low. Since air always takes the path of least resistance, it only touches the surface of the fabric and thus only absorbs surface humidity. The humidity in the interior of the fabric is only removed when it has reached the fabric surface by diffusion or a capillary effect. Whether and how much of the blown air will pass through the fabric depends on the distance between the blowing nozzle and the fabric, as well as on air permeability which is an inverse function of residual humidity.

Another drier for textile fabrics is disclosed by U.S. Pat. No. 4,219,942. In this drier, air from inclined nozzles is blown upon the textile fabric lying flat upon a conveyor belt. Vibrations are imparted to the conveyor belt by rotating vibrators in order to allow the material to shrink. The drying performance of this drier is quite low, as is its shrinkage performance.

In a further drier, known from BE-A No. 752 312, conveyor belts are made to vibrate by rotating vibrators in order to allow the fabric to shrink.

EP-A No. 0 137 066 teaches a device for drying and finishing textile fabrics which gives conventional drying results together with outstanding shrinking results. These results are achieved by means of conveyor belts made of stainless steel or aramid material such as Kevlar ®. The conveyors are provided with high frequency vibrations by means of beating rollers, and the vibrations are transferred to the fabric on the conveyor belts so that the tension in fibers and woven material can be loosened. With this type of drier, however, the resonant frequency of the vibrating conveyor belts is detuned by the fabric weight, which is a function of residual humidity.

At present, the machine known to have the best drying capacity is a suction drum, in which the fabric is compulsorily passed through in a direction from the outside toward the inside. In this machine, however, the fabric is fixed to the drum and cannot be lifted before the air stream has been cut and the change-over to the next drum or the machine exit has been released. Since there is no room for the fabric to move, it leaves the sieve drum with the same dimensions as when it entered the machine. Therefore, the shrinking potential inherent to the fabric is not reduced, and a special shrinking process must be added since fabric which will shrink 15 to 20% during the first washing is no longer commercially available.

A construction is known from FR-A No. 131 4360 which originally should eliminate the above-mentioned disadvantages of the sieve drum. However, this construction is unsuitable since it produces additional tensile stress in the fabric.

Finally, a device for tensionless drying of textile fabrics is known from DE-C No. 964 948. In this device, the fabric is moved forward on an upper conveyor belt as in a pendant loop drier, with the fabric loops lying on a lower conveyor belt, and the distance between the upper and lower conveyor belts is adjustable. The fabric is treated from above with low pressure air and from below with high pressure air.

SUMMARY OF THE INVENTION

It is an object of the present invention to provide a process and apparatus for treating textile fabrics which combines outstanding drying capacity with outstanding shrinking capacity.

Pursuant to this object, and others which will become apparent hereafter, one aspect of the present invention resides in a process for treating textile fabrics wherein air is sucked through the fabric by a suction nozzle arranged opposite a blowing nozzle. Additionally, the distance between the conveyor belt and the blowing and sucking nozzles is adjustable, depending upon the type of fabric being treated.

A further aspect of the present invention resides in an apparatus wherein suction nozzles are alternately arranged at a right angle above or below the conveyor belts so as to be opposite a blowing nozzle. Additionally, vibrators are provided so as to cause at least portions of one of the conveyor belts to vibrate.

With the present invention, the aeration which is known from the suction drum drier is combined with free and tensionless motion of the fabric, as well as mechanical treatment of the fabric. Due to the arrangement of the suction nozzles opposite the blowing nozzles, the textile fabric is pulled directly in front of the suction nozzle slot so that the air has no option but to pass through the fabric and drag along the humidity in the interior thereof. The optimum effect is achieved when each suction nozzle is arranged opposite a blowing nozzle. The nozzles are arranged so that the blowing or suction direction is essentially at right angles to the plane of the conveyor belts.

The blowing and suction nozzles cause the fabric to move with a sinusoidal wave motion in which the wave top touches the conveyor belt so as to feed part of the relaxation power to the fabric. Since the wave tops are steadily moving, the fabric is completely free to move in a longitudinal as well as a latitudinal direction so that the material can also shrink without interference. The remainder of the relaxation power is transferred to the wave tops touching the conveyor belt by vibration of the belt. Since only the wave tops of the fabric are touching the conveyor belt, the fabric weight has practically no influence on the resonant frequency of the conveyor belt and thus the values of the belt-nozzle distance and the vibration frequency which are initially set do not need to be readjusted.

A further advantage of the present invention is, in addition to drying and shrinking with the best possible results, finishing of the fabric. In the case of plush, the loops are unobjectionably raised and, with terrycloth toweling, a volume is achieved which can normally only be achieved in a tumbler. Additionally, creasing effects, etc. can be achieved.

In a further embodiment of the invention, the amount of air emitted from the blowing nozzles is adjusted to be higher than the amount of air entering the suction nozzles. As a result, a certain amount of air will pass over the fabric laterally so as to smooth the longitudinal edges of the fabric which generally tend to curl, particularly in the case of a slitted, tubular fabric.

The difference in the amount of blowing and suction air can also be adjusted as a function of the humidity saturation of the drying air. The exhaust air is removed from the drier and replaced by a corresponding amount of fresh air.

The conveyor belt must not operate at a constant speed and, preferably, has a speed which is modified according to the increasing shrinking of the fabric.

As mentioned above, aeration utilizing opposing suction nozzles pursuant to the present invention, results in a considerable increase in drying capacity, which enables a drastic reduction in the dimensions of the overall plant without changing the drying capacity thereof in comparison with the dimensions of conventional plants. This makes it possible to envision numerous improvements of the components, particularly the nozzles, of known arrangements. A reduced construction size is achieved by providing blowing and suction nozzles with a conical cross section which, over the length of the nozzle slot, which may be up to 2.5 m, results in a continuous air speed and a continuous outlet angle. At the same time, the height of the nozzle remains constant so that a low construction height is achievable.

Advantageously, modules are formed from a number of suction and blowing nozzles so that the finished installations can be readily adapted to the output required by the final user.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
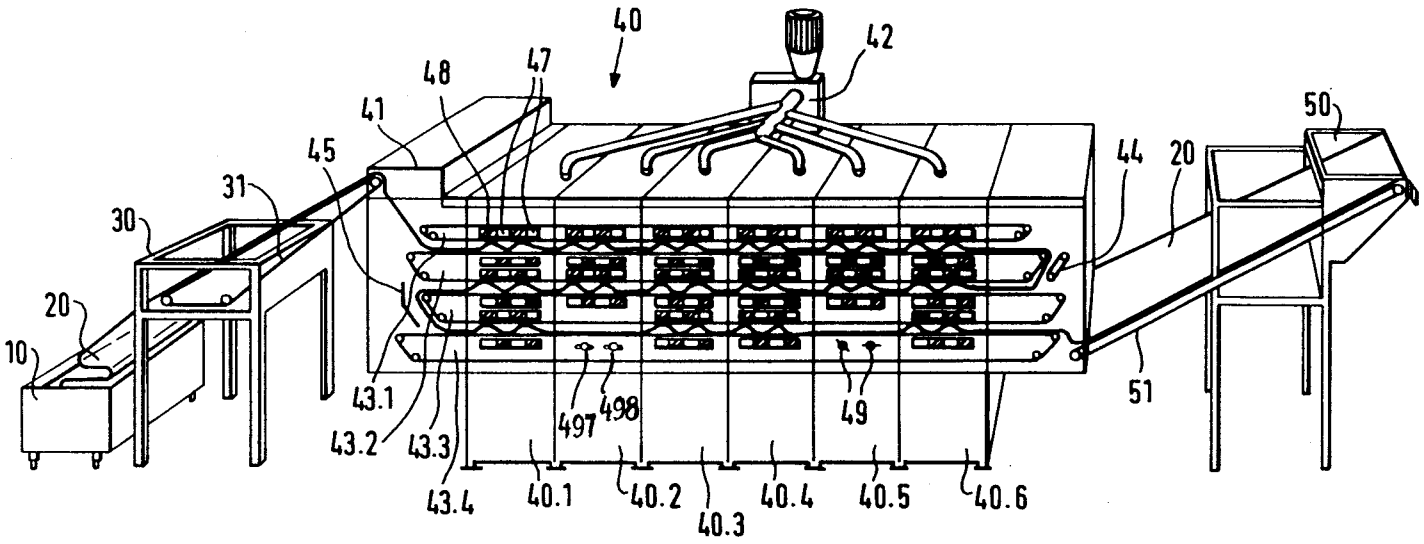
FIG. 1 shows an apparatus for drying, shrinking and finishing textile fabrics pursuant to the present invention, in perspective.

FIG. 1 illustrates diagrammatically in perspective a device for drying, shrinking and finishing textile fabrics and mainly consists of three basic elements, namely, the fabric input, the drier and the exit.

A textile fabric 20 is supplied in a movable transport container 10 and is transferred to a feeding device 41 of a drier 40 over a fabric guiding device 30 by means of a transport belt 31.

The drier 40 includes six triple-deck modules 40.1–40.6. Four endless conveyor belts 43.1 43.4 run through these modules 40.1–40.6. With a corresponding overfeed, the textile fabric runs between a lower part of the upper conveyor belt 43.1 and a upper part of an adjacent lower conveyor belt 43.2. Above the lower, untensioned part and below the upper, tensioned part, two blowing nozzles 47 and two suction nozzles 48 are alternately arranged in each module so that each suction nozzle 48 is opposite a blowing nozzle 47. Under the influence of the blowing and suction nozzles 47, 48, the fabric 20 runs in a well-known sinusoidal wave motion, with the wave top touching the conveyor belts 43.1–43.4.

The enormous mechanical energy which is already fed to the fabric 20 by the wave formation is additionally supported by vibration of the lower conveyor belt 43.4 by means of vibrators 49. In this way, the wave is deliberately compressed and the effects achieved thereby go beyond all expectations and include: that the overstretched meshes of a knitted fabric are brought back to their originally relaxed form; with plush fabric, for instance, the loops are unobjectionably raised, with terrycloth toweling, a volume is achieved which previously could only achieved in a tumbler; and creasing effects can be achieved in the textile cloth.

In order to avoid tensile stress in the fabric due to its own weight between the individual decks, transfer conveyors 44 or transfer slides 45 are provided between the decks.

To achieve the best possible wave form and the best possible residual shrinkage value, the belt distance and the nozzle distance, as well as the vibration frequency, can be adjusted steplessly according to the type of fabric and the fabric weight, as well as according to the required shrinkage potential. A construction for adjusting the nozzles is taught by No. GB-A-20 58 313.

The high drying capacity is achieved due to the arrangement of each suction nozzle opposite one of the blowing nozzles in that the drying air must pass through the fabric, thereby dragging along the humidity in the interior of the fabric and removing it therefrom.

Small amounts of the blowing air which do not pass through the fabric 20, pass over its surface to the outside, so that the fabric is smoothed. In the case of woven goods, the edges will be uncurled. This effect can be provided by adjusting the capacity of the blowing nozzles to be higher than the capacity of the suction nozzles.

The fabric 20 leaves the exit of the drier 40 via a fabric draw-off device 50 with an exit transport belt 51. If necessary, another cooling blower and a plaiting device can be provided.

Figure 2:
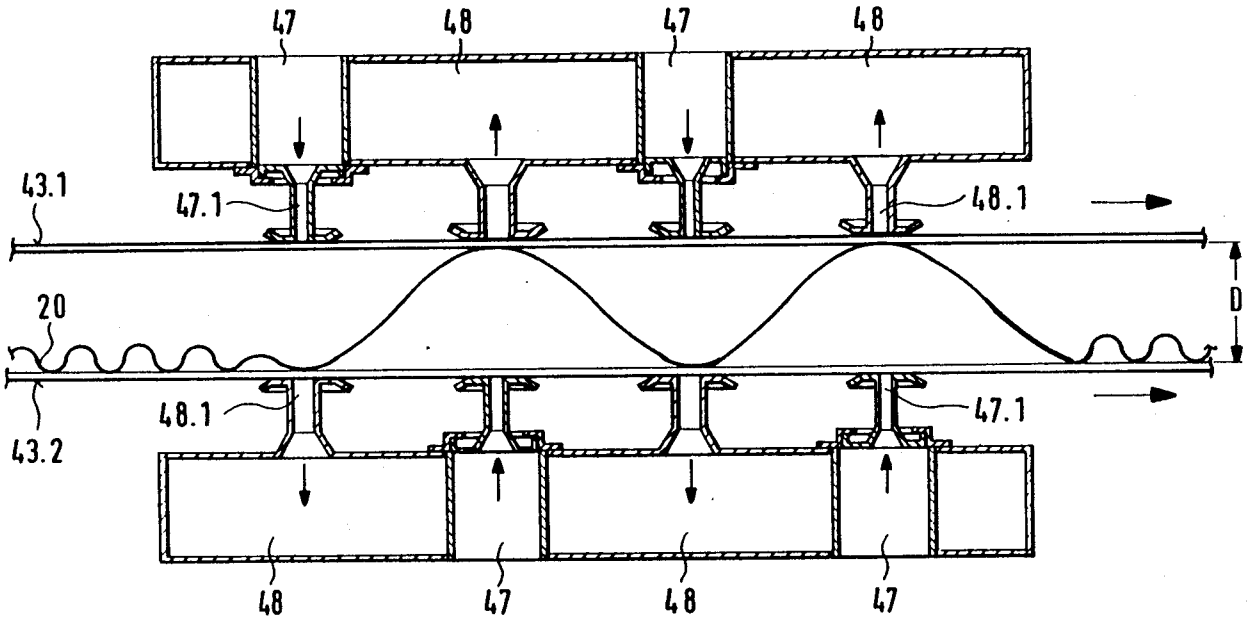
FIG. 2 is a side view of a cut-out of a drier in the area of the suction and blowing nozzles.
Figure 2A:
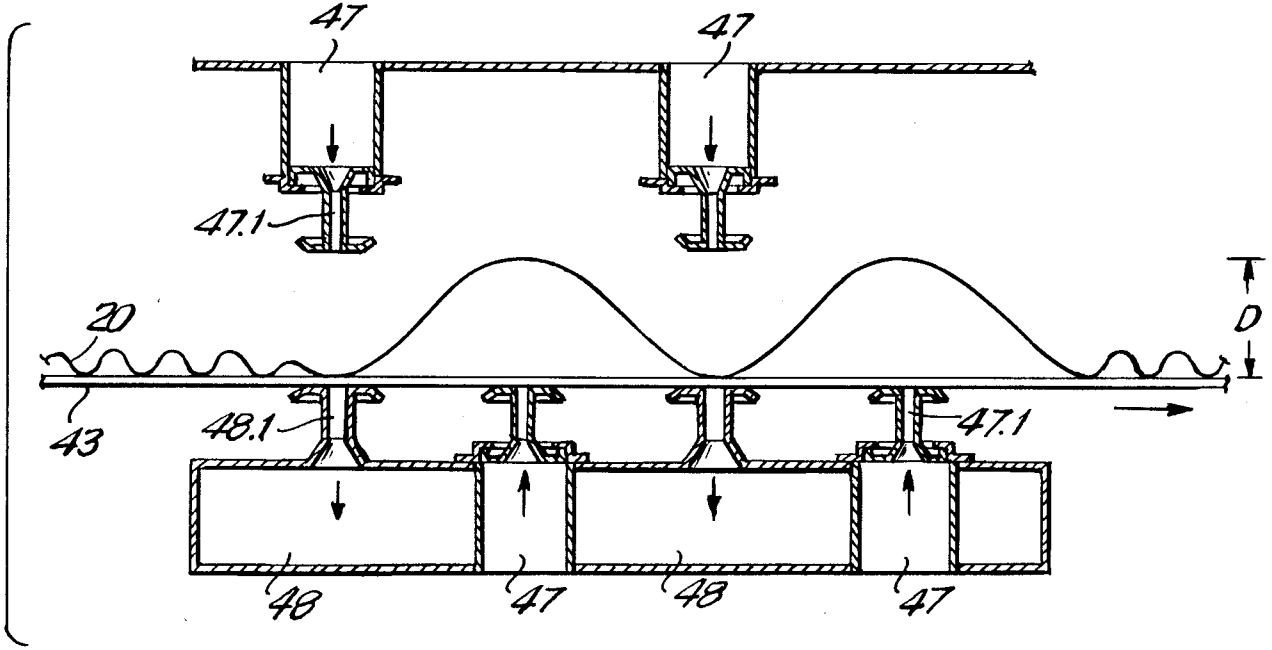
FIG. 2*a* is a view similar to that of FIG. 2, of another drier.

FIG. 2 illustrates a cut-out of the device of FIG. 1, in the region of the blowing and suction nozzles 47, 48 on an enlarged scale. This figure shows two conveyor belts 43.1, 43.2 upon the lower of which the fabric 20 is conveyed while resting upon them in a loose manner. Mouthpieces 47.1, 48.1 of the blowing nozzles 47 and the suction nozzles 48 are arranged to reach directly up to the rear side of the conveyor belts 43.1, 43.2 and are especially shaped so as to enable the conveyor belts 43.1, 43.2 to pass without friction or damage. A minimum distance between the mouthpiece 48.1 of the suction nozzles 48 and the textile fabric 20 is achieved in this way so that it is assured that a maximum amount of drying air is aspirated through the fabric 20 into the mouthpiece 48.1 of the suction nozzles 48.

The fabric 20 is supported between the wave troughs and the wave crests in a tensionless manner by the air flows from the nozzles. The wave troughs and crests move according to the speed of the conveyor belt 43 so that all portions of the fabric 20 are dried and shrunk.

If one of the conveyor belts 43 is made to vibrate by the vibrators 49, the vibrations are transmitted to the wave troughs and crests of the fabric 20 which intensifies the shrinking process without interfering with the drying process.

The conveyor belts 43.1, 43.2 and, correspondingly, the spacing between the mouthpieces 47.1, 48.1 of the blowing and suction nozzles 47, 48 have a spacing D therebetween which can be altered in order to enable an optimum adaptation to the properties of the fabric 20 being treated.

FIG. *2a* illustrates an arrangement wherein the fabric 20 is transported by a single conveyor belt 43. The suction nozzles 48 are arranged below the conveyor belt 43 and opposite the blowing nozzles 47 located above the conveyor belt 43. The blowing nozzles 47 remain arranged as in the embodiment of FIG. 2.

Figure 4:
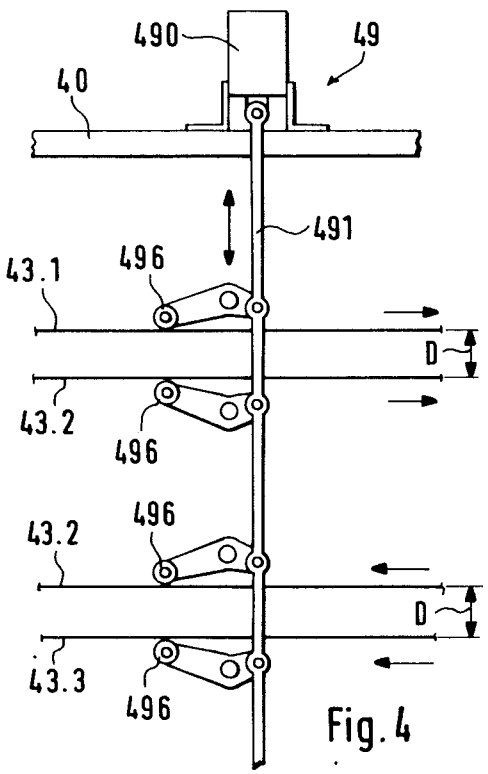
FIG. 4 shows a cut-out of a side view of the drier incorporating a second vibrator embodiment.
Figure 3:
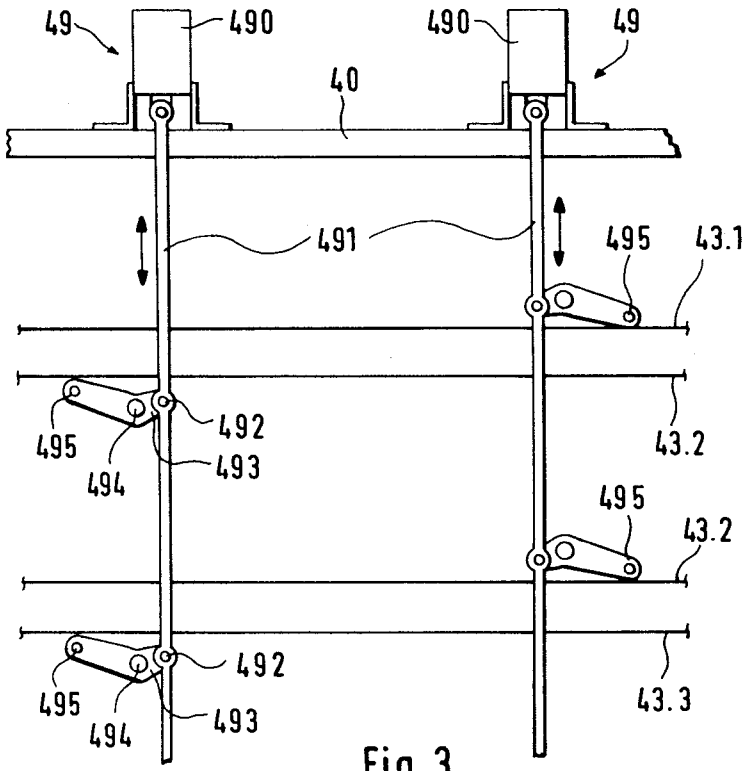
FIG. 3 is a cut-out from a side view of the drier with a first embodiment of a vibrator.

FIGS. 3 and 4 are enlarged illustrations of two embodiments of the vibrators 49 which help the conveyor belts 43 to vibrate. Oscillating cylinders 490, which are either hydraulic or pneumatic, are installed at the housing of the drier 40. The cylinders 490 move oscillating lifting rods 491 to which twin arm levers 493 are articulated by rotary joints 492. The twin arm levers 493 are supported at the housing of the drier 40 by means of bearings 494. The free ends of the twin arm levers 493 carry impact or striker strips 495 which respectively cause the lower conveyor belts 43.3, 43.4 or the upper conveyor belts 43.1, 43.2 to vibrate.

As illustrated in FIG. 4, the lower and upper conveyor belts 43.1, 43.2, 43.3 can also be made to vibrate in unison if the resonant frequencies coincide.

In order to reduce wear on the impact strips 495 and the conveyor belts 43, impact rollers 496 can be installed in a rotary manner upon the impact strips 495.

Rotating cam shafts 497 having cams 498, can also be utilized to vibrate the conveyor belts 43, as depicted in FIG. 1 in the region of the lowermost conveyor belt 43.4.

While the invention has been illustrated and described as embodied in a process and apparatus for treatment of textile fabrics, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

1. A process for treating textile fabrics, comprising the steps of:

conveying the fabric along a moving surface at an overfeed relative to the moving surface;

blowing air streams against the fabric alternately from above and below;

sucking air streams essentially perpendicularly through the fabric at areas opposite where an air stream is blown in.

2. A process as defined in claim 1, and further comprising the step of vibrating the moving surface.

3. A process as defined in claim 1, wherein said conveying step includes conveying the fabric with one conveyor belt, said blowing step including blowing the air streams from blowing nozzles arranged alternately above and below the conveyor belt and the fabric, respectively, and said sucking step including sucking air streams through the fabric with suction nozzles arranged on a backside of the conveyor belt so that each suction nozzle is opposite a blowing nozzle.

4. A process as defined in claim 1, wherein said conveying step includes conveying the fabric between two approximately parallel running conveyor belts, said blowing step including blowing the air streams from blowing nozzles arranged alternately above and below the conveyor belts.

5. A process as defined in claim 4, wherein said sucking step includes sucking air streams through the fabric with suction nozzles arranged so that each suction nozzle is opposite a blowing nozzle.

6. A process as defined in claim 5, and further comprising the step of adjusting a distance between the conveyor belts and associated blowing and suction nozzles as a function of fabric type, fabric weight and shrink potential, respectively.

7. A process according to claim 4, and further comprising the step of vibrating at least one of the conveyor belts with a vibration frequency tuned to fabric weight, fabric type and shrink potential, respectively.

8. A process according to claim 1, and further comprising the steps of removing an amount of drying air corresponding to a degree of humidity saturation, and replacing a corresponding amount of fresh air.

9. A process according to claim 4, wherein said conveying step includes adjusting the speed of the conveyor belts in response to progressive shrinking of the fabric.

10. A process according to claim 5, wherein said blowing step includes passing an amount of air through the blowing nozzle which is larger than the amount sucked through the fabric by the opposing suction nozzle.

11. An apparatus for treatment of textile fabrics, comprising:

conveyor means for moving the fabric;

means for blowing air streams against the fabric alternately from above and below; and means for sucking air streams, arranged directly opposite said blowing means.

12. An apparatus as defined in claim 11, wherein said conveyor means includes two essentially parallel running conveyor belts arranged one above the other, said blowing means including blowing nozzles arranged at right angles to and alternately above and below said conveyor belts so that the air streams alternately move the fabric against an upper and a lower conveyor belt.

13. An apparatus as defined in claim 11, and further comprising means for heating the air stream.

14. An apparatus as defined in claim 12, wherein said sucking means includes suction nozzles arranged at right angles to and alternately above and below said conveyor belts, one suction nozzle being arranged opposite each blowing nozzle.

15. An apparatus as defined in claim 14, wherein said conveyor belts and associated blowing and suction nozzles are provided so as to have an adjustable spacing therebetween.

16. An apparatus as defined in claim 11, wherein said blowing means and said sucking means include blowing nozzles and suction nozzles, respectively, arranged so as to direct the air streams essentially perpendicular to said conveyor means.

17. An apparatus as defined in claim 11, and further comprising means for vibrating at least a portion of said conveyor means.

18. An apparatus as defined in claim 17, wherein said conveyor means includes two essentially parallel running conveyor belts arranged one above the other, said vibrating means causing at least one section of one of said conveyor belts to vibrate.

19. An apparatus as defined in claim 17, wherein said vibrating means includes at least one rotating camshaft.

20. An apparatus as defined in claim 17, wherein said vibrating means includes an oscillating cylinder, an oscillating lifting rod and at least one oscillating impact bar, connected together so that said impact strip strikes said conveyor means by activation of said oscillating cylinder.

21. An apparatus as defined in claim 20, wherein said oscillating cylinder is hydraulic.

22. An apparatus as defined in claim 20, wherein said oscillating cylinder is pneumatic.

23. An apparatus as defined in claim 20, wherein said vibrating means further includes at least one twin arm-lever having one end articulated to said lifting rod, and another end which carries said impact strip.

24. An apparatus as defined in claim 20, wherein said vibrating means further includes a striking roller rotatably connected to said impact strip.

25. An apparatus as defined in claim 17, wherein said vibrating means has an adjustable frequency.

26. An apparatus as defined in claim 12, wherein said conveyor belts are woven of aramid material.

27. An apparatus as defined in claim 14, wherein said blowing nozzles and said suction nozzles have a conical cross-section and a constant height.

28. An apparatus as defined in claim 14, wherein said blowing nozzles, said suction nozzles and said vibrating means are arranged into modules which are mutually combinable.

29. An apparatus as defined in claim 11, wherein said conveyor means includes a single conveyor belt, said blowing means including blowing nozzles arranged at right angles to and alternately above and below said conveyor belt and the fabric, said sucking means including suction nozzles arranged on a backside of said conveyor belt so that each suction nozzle is opposite a blowing nozzle.

* * * * *